US005365916A

United States Patent [19]

Freiburg et al.

[11] Patent Number: 5,365,916

[45] Date of Patent: Nov. 22, 1994

[54] COMPRESSION RELEASE ENGINE BRAKE SLAVE PISTON DRIVE TRAIN

[75] Inventors: Kurt E. Freiburg, West Hartford, Conn.; James D. Liebel, Springfield, Mass.

[73] Assignee: Jacobs Brake Technology Corporation, Wilmington, Del.

[21] Appl. No.: 81,978

[22] Filed: Jun. 23, 1993

[51] Int. Cl.[5] ..... F01L 1/14; F01L 13/06

[52] U.S. Cl. ..... 123/320

[58] Field of Search ..... 123/320, 321, 90.16

[56] References Cited

U.S. PATENT DOCUMENTS

| | | | |
|---|---|---|---|
| 2,882,877 | 4/1959 | Dierksen | 123/90.61 |
| 4,473,047 | 9/1984 | Jakuba et al. | 123/323 |
| 4,721,074 | 1/1988 | Wirth et al. | 123/90.23 |
| 4,773,360 | 9/1988 | Heimburg | 123/90.23 |
| 4,793,307 | 12/1988 | Quenneville et al. | 123/323 |
| 4,856,474 | 8/1989 | Tisch | 123/323 |
| 4,864,983 | 9/1989 | Breitbarth | 123/90.61 |
| 5,036,810 | 8/1991 | Meneely | 123/90.16 |
| 5,165,375 | 11/1992 | Hu | 123/321 |
| 5,183,018 | 2/1993 | Vittorio et al. | 123/321 |
| 5,195,489 | 3/1993 | Reich | 123/321 |

*Primary Examiner*—David A. Okonsky
*Attorney, Agent, or Firm*—Robert R. Jackson

[57] ABSTRACT

The slave piston drive train in a compression release engine braking system includes a slave piston with a rigidly connected extension. The end of the extension remote from the main body of the slave piston is spherically convex. A bearing pad or foot fits in swivel fashion on this spherically convex end. The outer surface of the foot opposite the spherically convex extension end is substantially flat and bears on a substantially flat surface on an exhaust valve rocker arm.

1 Claim, 1 Drawing Sheet

COMPRESSION RELEASE ENGINE BRAKE SLAVE PISTON DRIVE TRAIN

BACKGROUND OF THE INVENTION

This invention relates to compression release engine brakes, and more particularly to improved structures for coupling the slave pistons in such engine brakes to the exhaust valves in the associated internal combustion engine.

Compression release engine brakes or retarders are well known as shown, for example, by Jakuba et al. U.S. Pat. No. 4,473,047. Such devices typically operate by opening an exhaust valve in a cylinder in the internal combustion engine associated with the brake near top dead center of the compression stroke of that cylinder. This releases gas compressed during the compression stroke and prevents the work of compression from being recovered during the subsequent "power" stroke of the cylinder. In effect, the engine brake, while it is on, converts the engine from a power source to a power consuming gas compressor. This power consumption enables the engine to help slow down the associated vehicle, thereby saving wear on the vehicle's normal wheel brakes.

The typical compression release engine brake produces the exhaust valve openings described above by using a hydraulic circuit to pick up an appropriately timed motion from another part of the engine and to transfer that motion to the exhaust valve to be opened. A master piston in this hydraulic circuit receives the mechanical input from the engine. The hydraulic circuit transmits that input to a slave piston in the circuit. The slave piston moves in response to the transmitted input, thereby producing a mechanical output which is coupled to the exhaust valve in order to open that valve.

The force which must be transmitted from the slave piston to the exhaust valve is typically quite high. This has made it necessary to give careful attention to the design of the drive train between the slave piston and the associated exhaust valve or valves. It is known to have the slave piston contact the end of the exhaust valve stem, the exhaust valve bridge (where there are two exhaust valves per cylinder), or the end of the exhaust valve rocker arm adjusting screw. However, each of these known structures may have one or more disadvantages. It may be difficult to design the engine brake so that the slave piston is always properly aligned with the relatively small end of an exhaust valve stem or the similarly small end of a rocker arm adjusting screw. If such relatively small surfaces are to be used to transmit the large forces necessary in engine brakes, it is very important to achieve proper alignment. Any misalignment reduces the areas in contact with one another, thereby further increasing the stress on parts that are already highly stressed. With regard to using the exhaust valve bridge, it may be difficult to design the engine brake so that the slave piston contacts that bridge in a perfectly balanced way. If such balance is not achieved, the exhaust valve bridge may tend to cock and therefore wear unsymmetrically or otherwise malfunction. The exhaust valve bridge may also be surrounded by other structures, making it difficult to design an engine brake slave piston that can reach it.

Commonly assigned Hu U.S. Pat. No. 5,165,375 shows a master piston having a rigidly attached push rod with a swivel foot mounted on the spherically convex end of the push rod. The swivel foot bears on the engine part which provides the mechanical input to the engine brake. The load on the master piston drive train, however, is typically substantially less than the load on the slave piston drive train.

Commonly assigned Reich U.S. Pat. No. 5,195,489 shows a structure in which the slave (or master) piston has a push rod that can rock in a socket in the associated slave piston. The other end of the push rod bears on a rocker arm via a foot mounted in swivel fashion on the spherically convex end of the push rod. This structure works well but it may be more complicated and expensive than is necessary in some situations.

In view of the foregoing it is an object of this invention to improve and/or simplify the structures used in the slave piston drive trains of compression release engine braking systems.

SUMMARY OF THE INVENTION

This and other objects of the invention are accomplished in accordance with the principles of the invention by providing a slave piston with a rigidly connected extension having a spherically convex end remote from the main body of the slave piston. A bearing pad or foot is mounted in swivel fashion on the convex end of the extension. A substantially flat or slightly convex outer surface of the foot opposite the convex end of the extension bears on a substantially flat or slightly convex surface provided on an exhaust valve rocker arm in the associated engine. Preferably this substantially flat or slightly convex rocker arm surface is specially provided for receiving the outer surface of the foot.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
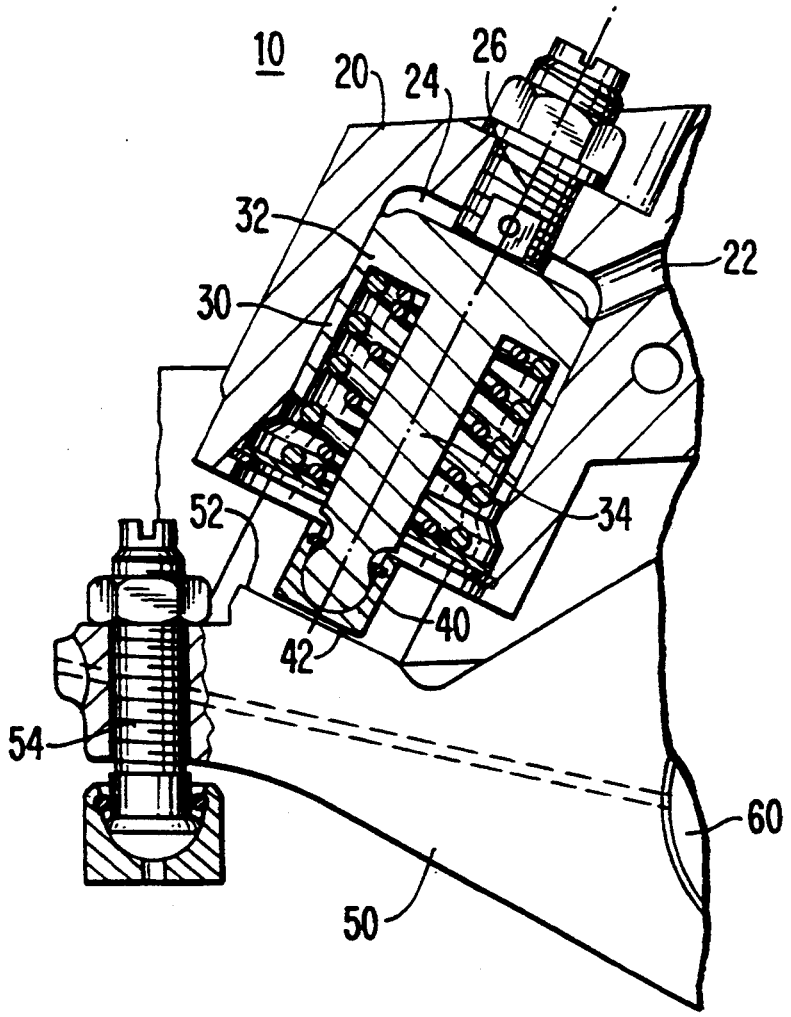
FIG. 1 is a simplified elevational view, partly in section, of a compression release engine braking system slave piston drive train constructed in accordance with the principles of this invention.

As shown in FIG. 1, engine brake 10 includes a body or housing 20 having a hydraulic circuit 22 which includes a slave piston bore 24. Slave piston 30 is disposed in bore 24 for reciprocation along the longitudinal axis 26 of the bore and the slave piston. Slave piston 30 includes a main body 32 which is in contact with the hydraulic fluid in circuit 22. Slave piston 30 further includes an extension 34 which is rigidly connected to or integral with main body 32. The end of extension 34 that is remote from main body 32 is substantially spherically convex.

A bearing pad or foot 40 is mounted on the spherically convex end of extension 34. Foot 40 has a substantially spherically concave inner surface which is concentric with the spherically convex end of the extension. The spherically convex end of the extension is received within and mates with this inner surface in complementary fashion. Foot 40 is preferably secured to extension 34 by means which are not shown in detail in FIG. 1 but which may be similar to the spring 26 which holds the foot 23 on the end of master piston body 12 as shown, for example, in FIGS. 3 and 4 of above-mentioned Hu U.S. Pat. No. 5,165,375. Other apparatus suitable for securing foot 40 to extension 34 in this fashion is shown in Reich U.S. Pat. No. 5,195,489 (see the spring 42 which holds the foot 40 on the end of the push rod shown in FIG. 1 of the Reich patent). As in the case of the Hu and Reich patent devices, the means for securing foot 40 to extension 34 preferably allows some limited pivoting or swivelling of foot 40 relative to extension 34. Both the Reich and Hu patents are hereby incorporated by reference herein.

The outer surface 42 of foot 40 opposite to the above-described spherically concave surface is preferably substantially flat, although surface 42 may alternatively be slightly convex, and it will accordingly be understood that the term "substantially flat" as used herein includes the possibility of such slight convexity. Substantially flat surface 42 bears on a substantially flat surface 52 provided on exhaust valve rocker arm 50. Again, surface 52 may alternatively be slightly convex, and it will be understood that the term "flat" as used with reference to surface 52 includes the possibility of such slight convexity. Rocker arm 50 is part of the engine associated with engine brake 10 and it oscillates about engine shaft 60. Rocker arm 50 carries rocker arm adjusting screw assembly 54, the lower end of which bears on an exhaust valve part or mechanism (not shown). It will be noted that surface 52 is substantially perpendicular to axis 26 and radially spaced from shaft 60. Surface 52 is also substantially perpendicular to the plane in which rocker arm 50 oscillates about shaft 60.

When engine brake 10 is in operation, fluid in hydraulic circuit 22 periodically pushes slave piston 30 outwardly of bore 24 by a predetermined amount. This causes slave piston 30, acting through foot 40, to rotate rocker arm 50 counter-clockwise about shaft 60. This counter-clockwise rotation of rocker arm 50 depresses the exhaust valve part or mechanism contacted by adjusting screw assembly 54, thereby opening one or more exhaust valves in the engine associated with brake 10.

The relatively large contact area between the convex end of extension 34 and the concave inner surface of foot 40 prevents excessive stress concentrations at this interface. Foot 40 can swivel or pivot on the end of extension 34 so that even though the angle of surface 52 is changing relative to axis 26, the substantially flat outer surface 42 of foot 40 can remain fully in contact with substantially flat surface 52. This ensures a relatively large contact area between foot 40 and surface 52 at all times, thereby again avoiding excessive stress concentrations at the interface between foot 40 and rocker arm 50. Foot 40 may slide a small amount along surface 52, but the avoidance of excessively high contact stress on that surface as described above makes this sliding an acceptable condition in many situations, thereby avoiding the need for the more complex and costly rocking push rods shown in Reich U.S. Pat. No. 5,195,489.

It will be understood that the foregoing is only illustrative of the principles of this invention, and that various modifications can be made by those skilled in the art without departing from the scope and spirit of the invention. For example, foot 40 may be held to extension 34 by means other than those mentioned specifically above. The location of surface 52 on rocker arm 50 may also be changed.

The invention claimed is:

1. In a compression release engine braking system, apparatus for transmitting force and motion from a hydraulic circuit in the engine brake to open an exhaust valve in an internal combustion engine associated with the engine brake comprising:

a slave piston disposed in contact with said hydraulic circuit for reciprocation along a first axis, said slave piston having a main body and an extension rigidly attached to said main body and extending from said main body parallel to said first axis in a direction away from said hydraulic circuit, the end of said extension which faces away from said main body being substantially spherically convex;

a bearing pad rotatably secured to said spherically convex end of said extension, said bearing pad having a spherically concave inner surface which is substantially concentric with said spherically convex end received in said inner surface, and a substantially flat outer surface opposite said inner surface; and an exhaust valve rocker arm mounted for oscillation about a shaft in a first plane which is perpendicular to said shaft, said rocker arm having a substantially flat bearing surface which is substantially perpendicular to said first plane and to said first axis and which is radially spaced from said shaft, said outer surface bearing on said bearing surface in order to cause reciprocation of said slave piston to oscillate said rocker arm and thereby open an exhaust valve controlled by said rocker arm.

* * * * *

UNITED STATES PATENT AND TRADEMARK OFFICE

CERTIFICATE OF CORRECTION

PATENT NO. : 5,365,916

DATED : November 22, 1994

INVENTOR(S) :

Kurt E. Freiburg and James D. Liebel

It is certified that error appears in the above-indentified patent and that said Letters Patent is hereby corrected as shown below:

| Column | Line No. | |
|---|---|---|
| 3 | 20 | Insert --substantially-- inside the quotation marks before the word "flat". |

Signed and Sealed this

Twentieth Day of June, 1995

*Attest:*

Bruce Lehman

BRUCE LEHMAN

*Attesting Officer*

*Commissioner of Patents and Trademarks*